United States Patent [19]

Oehler et al.

[11] Patent Number: 4,693,017

[45] Date of Patent: Sep. 15, 1987

[54] CENTRIFUGING INSTALLATION

[75] Inventors: Henry Oehler, Hennef; Norbert Peth, Much; Hans W. Holpp; Wolfgang Sass, both of Hennef, all of Fed. Rep. of Germany

[73] Assignee: Gebr. Steimel, Hennef, Fed. Rep. of Germany

[21] Appl. No.: 788,063

[22] Filed: Oct. 16, 1985

[30] Foreign Application Priority Data

Oct. 16, 1984 [DE] Fed. Rep. of Germany ... 8430403[U]

[51] Int. Cl.[4] ..... F26B 11/08

[52] U.S. Cl. ..... 34/58; 34/236; 294/67.31; 294/67.33; 294/683; 414/411

[58] Field of Search ..... 34/58, 236; 414/411, 414/626; 294/90, 68.3, 67.31, 67.33

[56] References Cited

U.S. PATENT DOCUMENTS

| | | | |
|---|---|---|---|
| 2,692,692 | 10/1954 | Johnson | 414/411 |
| 3,899,205 | 8/1975 | Lanigan et al. | 294/67.31 |
| 4,090,309 | 5/1978 | Rollins | 34/58 |
| 4,252,358 | 2/1981 | Klebs | 294/67.33 |
| 4,412,390 | 11/1983 | Grant | 34/58 |
| 4,464,846 | 8/1984 | Itoh et al. | 34/58 |
| 4,470,744 | 9/1984 | Steimel | 414/420 |
| 4,545,135 | 10/1985 | Barriquano et al. | 34/58 |
| 4,593,479 | 6/1986 | Pignal et al. | 34/58 |

FOREIGN PATENT DOCUMENTS

| | | |
|---|---|---|
| 2030591 | 6/1970 | Fed. Rep. of Germany . |
| 3010960 | 10/1981 | Fed. Rep. of Germany . |

*Primary Examiner*—Albert J. Makay
*Assistant Examiner*—David W. Westphal
*Attorney, Agent, or Firm*—Michael J. Striker

[57] ABSTRACT

A centrifuge installation comprises at least one centrifuge which is loaded and emptied automatically and has an axis, has a centrifuge drum which is provided with the receiving frame, the receiving frame which is rectangular in a plan view and has four corners spaced at equal distances from the centrifuge axis, a plurality of containers which can be filled with industrial piece goods and are insertable into the centrifuge, the container have walls with passages for centrifuged liquid and an upper edge are formed as boxes in a plan view insertable into the receiving frame, a fixing device provided in the centrifuge and arranged to hold the centrifuge drum after braking in a predetermined position, a cover arranged to close the boxes and provided with a locking device, and a gripping device for the boxes, the gripping device is provided with an actuating device for opening and closing the locking device of the cover, the gripping device is also provided with a cover holder which fixes the cover after opening of the locking device and releases the same after closing of the locking device.

8 Claims, 7 Drawing Figures

FIG.4
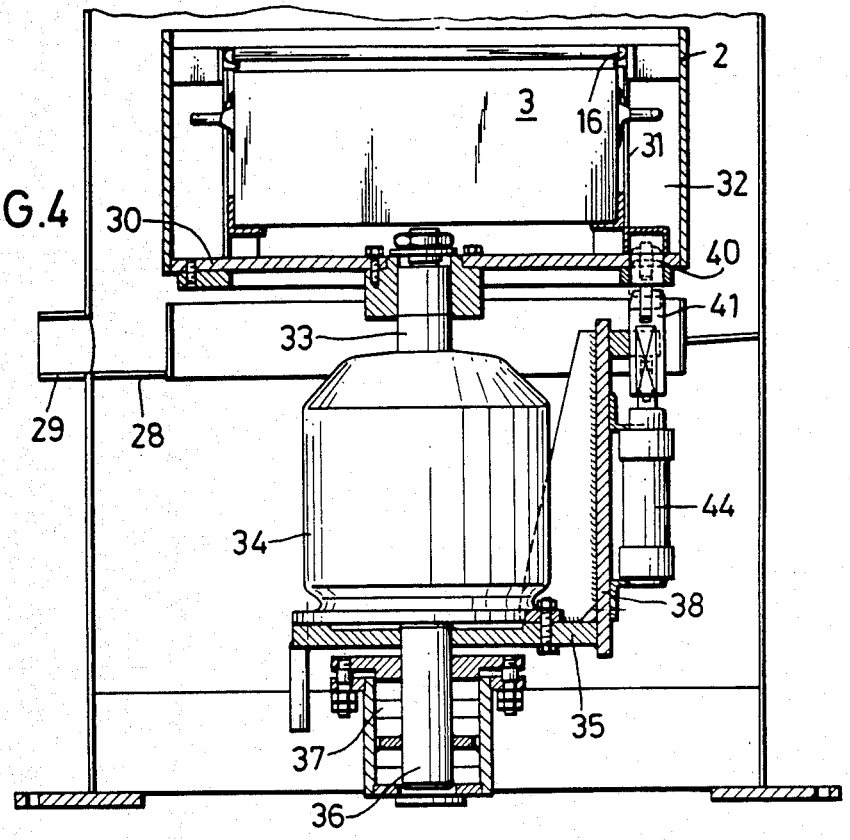
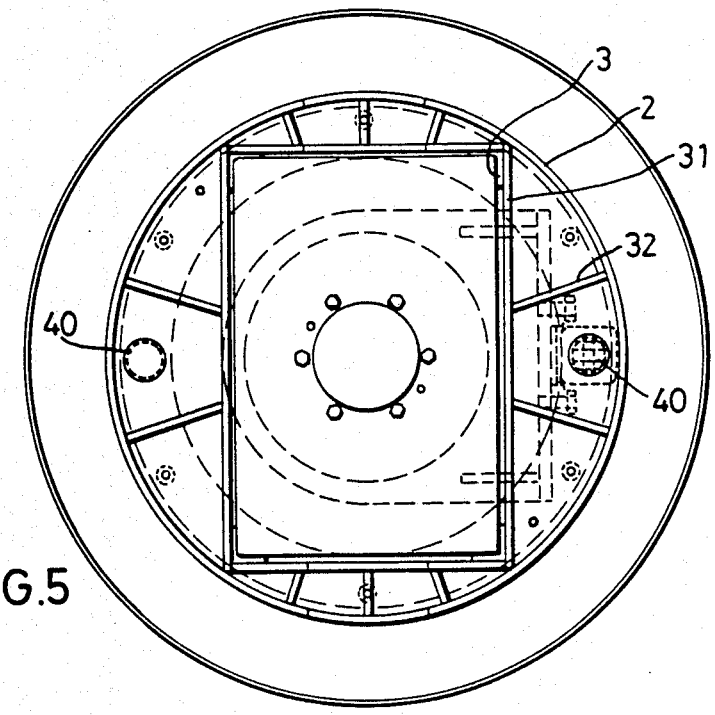
FIG.5

CENTRIFUGING INSTALLATION

BACKGROUND OF THE INVENTION

The present invention relates to a centrifuging installation. More particularly, it relates to a centrifuging installation which has at least one automatically chargeable and emptiable centrifuge with a gripping device arranged above the centrifuge for gripping, lifting, transporting and discharging of containers to be filled with industrial piece goods and inserted into the centrifuge with passage of centrifuge liquid through wall passages of the container.

Centrifuging installations of the abovementioned general type are known in the art. Some of such installations are disclosed, for example, in the DE-OS Nos. 2,030,591 and 3,010,960 In the known automatically chargeable and emptiable centrifuges of this type a container for industrial piece goods is formed by a centrifuge drum. This has the disadvantage that for one centrifuge several centrifuge drums must be available. Also, the goods to be treated must be filled into a centrifuge drum and after centrifuging emptied by means of a drum tilting device. Especially for treating of impact-sensitive piece goods, such as for example parts provided with threads and the like, the two-step filling process is disturbing because of the time consumption or because of the possible damages to the teethed goods. Since the centrifuge drums are relatively heavy, the gripping device which grips the upper edge of the centrifuge drum must be designed so that it can lift, transport and lower the high weight.

Centrifuges are often known in which the industrial piece goods are supplied in boxes, for example over roller tracks and introduced together with the boxes manually into the centrifuge drum. After centrifuging the boxes with the centrifuged piece goods are manually removed from the centrifuge.

SUMMARY OF THE INVENTION

Accordingly, it is an object of the present invention to provide a centrifuge installation which avoids the disadvantages of the prior art.

More particularly, it is an object of the present invention to provide a centrifuge installation with an automatically chargeable and emptiable centrifuge, in which conventional transporting boxes filled with piece goods are automatically inserted into the centrifuge, removed from the centrifuge and supplied to a discharge device.

In keeping with these objects and with others which will become apparent hereinafter, one feature of the present invention resides, briefly stated, in a centrifuge installation which comprises at least one centrifuge which is loaded and emptied automatically and has an axis, the centrifuge having a centrifuge drum which is provided with the receiving frame, the receiving frame being rectangular in a plan view and having four corners spaced at equal distances from the centrifuge axis, the centrifuge having a centrifuge drum, a plurality of containers which can be filled with industrial piece goods and are insertable into the centrifuge, the containers having walls with passages for centrifuged liquid and an upper edge, the containers being formed as boxes in a plan view insertable into the receiving frame, fixing means provided in the centrifuge and arranged to hold the centrifuge drum after bringing in a predetermined position, a cover arranged to close the boxes and provided with locking means, and gripping means for the boxes, the gripping means being provided with actuating means for opening and closing the locking means of the cover, the gripping means being also provided with a cover holder which fixes the cover after opening of the locking means and releases the same after closing of the locking means.

The centrifuging installation in accordance with the present invention has the advantage that industrial piece goods supplied in relatively light transporting boxes for example over a roller track or a conveyor are introduced together with the boxes into a centrifuge, lifted after the centrifuging with the boxes from the centrifuge, and discharged by a discharge device. A decanting of the goods to be treated does not take place.

Advantageously, a supply device and gripping device, and a discharging device are associated with at least two centrifuges, so that the gripping device engages a filled box in the supply station and inserts it into an empty centrifuge, while the other centrifuge centrifuges the box which has been inserted before.

Since the gripping device of the rectangular box can be lowered into the respective rectangular receiving frame of the centrifuge drum, it is required that the centrifuge drum be fixed after its braking in a definite predetermined positon. This predetermined position can be reached when the centrifuge drum after its braking to stoppage for example by a friction wheel which abuts against the drum, moves to an exact position in which a spring-biased catch engages the same in a springy manner.

In accordance with an advantageous embodiment of the invention, a vertically drivable pin is arranged under the bottom of the centrifuge drum and can engage in one of two recesses which are provided diametrically opposite in the drum bottom. After stopping of the centrifugal drum to its immovable position, the drum obtains via its drive motor one or several small impulses which are sufficient to rotate the centrifuge drum about approximately 180° . The pin which abuts against the drum bottom with a spring force senses the drum bottom and moves under the action of a spring into one of both recesses as long as the drum bottom reaches the proper position The gripping device arranged above the centrifuge can now be lowered. The gripping levers provided with claws can engage under an edge bead of the box to be lifted, and the box with the centrifuged goods is lifted from the centrifuge drum to be transported to the discharge device and discharged there.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWING

FIG. 4 is a view showing a section of one centrifuge with fixing device for a centrifuge drum;

FIG. 5 is a plan view of the centrifuge of FIG. 4;

DESCRIPTION OF THE PREFERRED EMBODIMENTS

Figure 1:
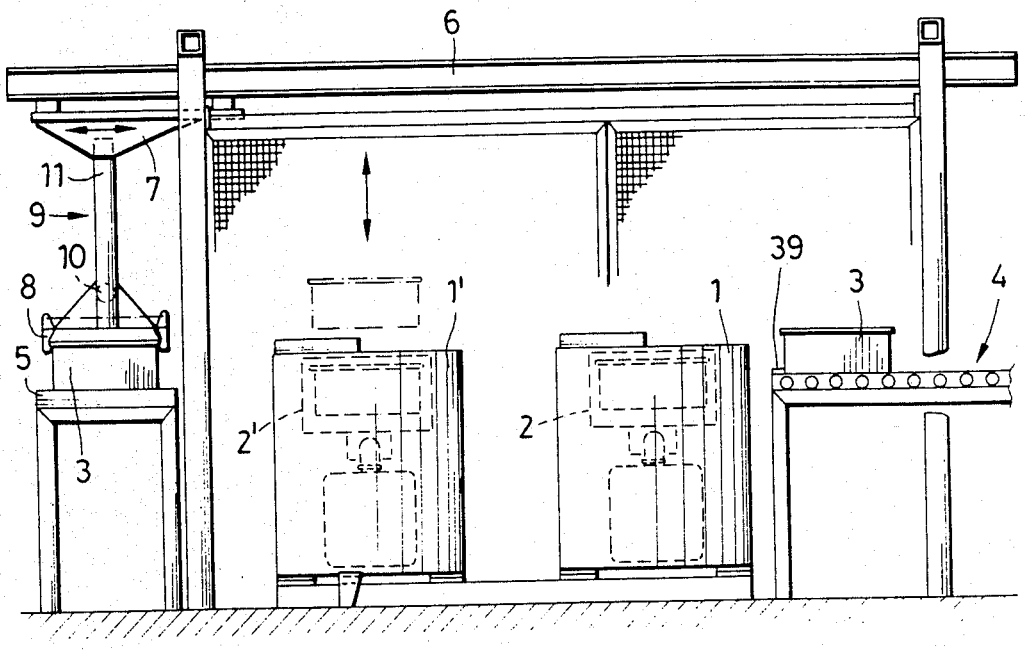
FIG. 1 is a side view of a centrifuge installation with a gripping device and two centrifuges in accordance with the present invention.
Figure 2:
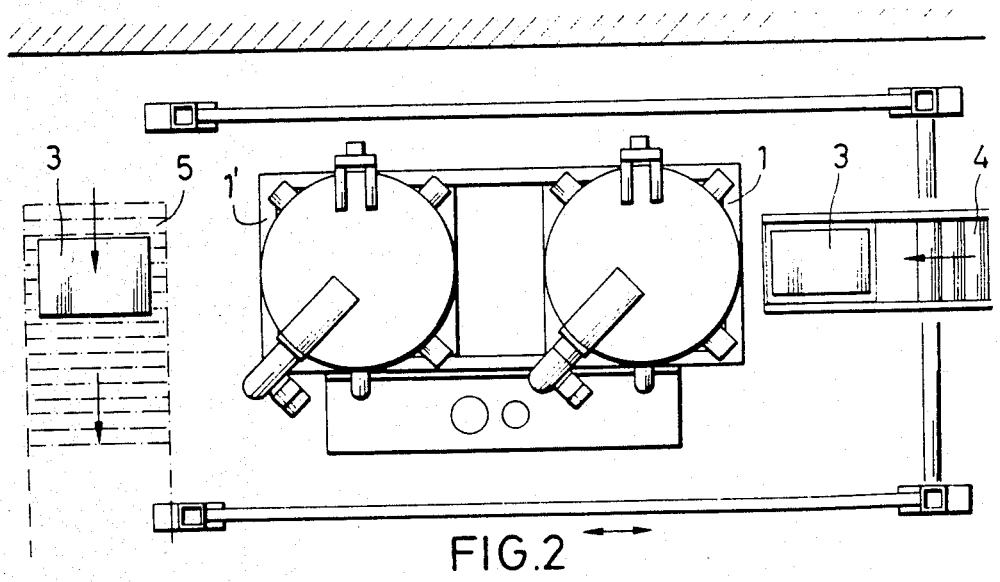
FIG. 2 is a plan view of the centrifuging installation of FIG. 1.

A centrifuging installation in accordance with the present invention is shown as a whole in FIGS. 1 and 2. It includes two centrifuges 1 and 1'. A supply device 4 supplies industrial piece goods to be treated to rectangular boxes 3. A discharge device 5 transports away the boxes 3 which are centrifuged in the centrifuge 1 and 1'. A displaceable as well as liftable and lowerable gripping device 8 is supported by a carriage 7 which is movable on a track 6 arranged above the centrifuges 1 and 1'.

Figure 3:
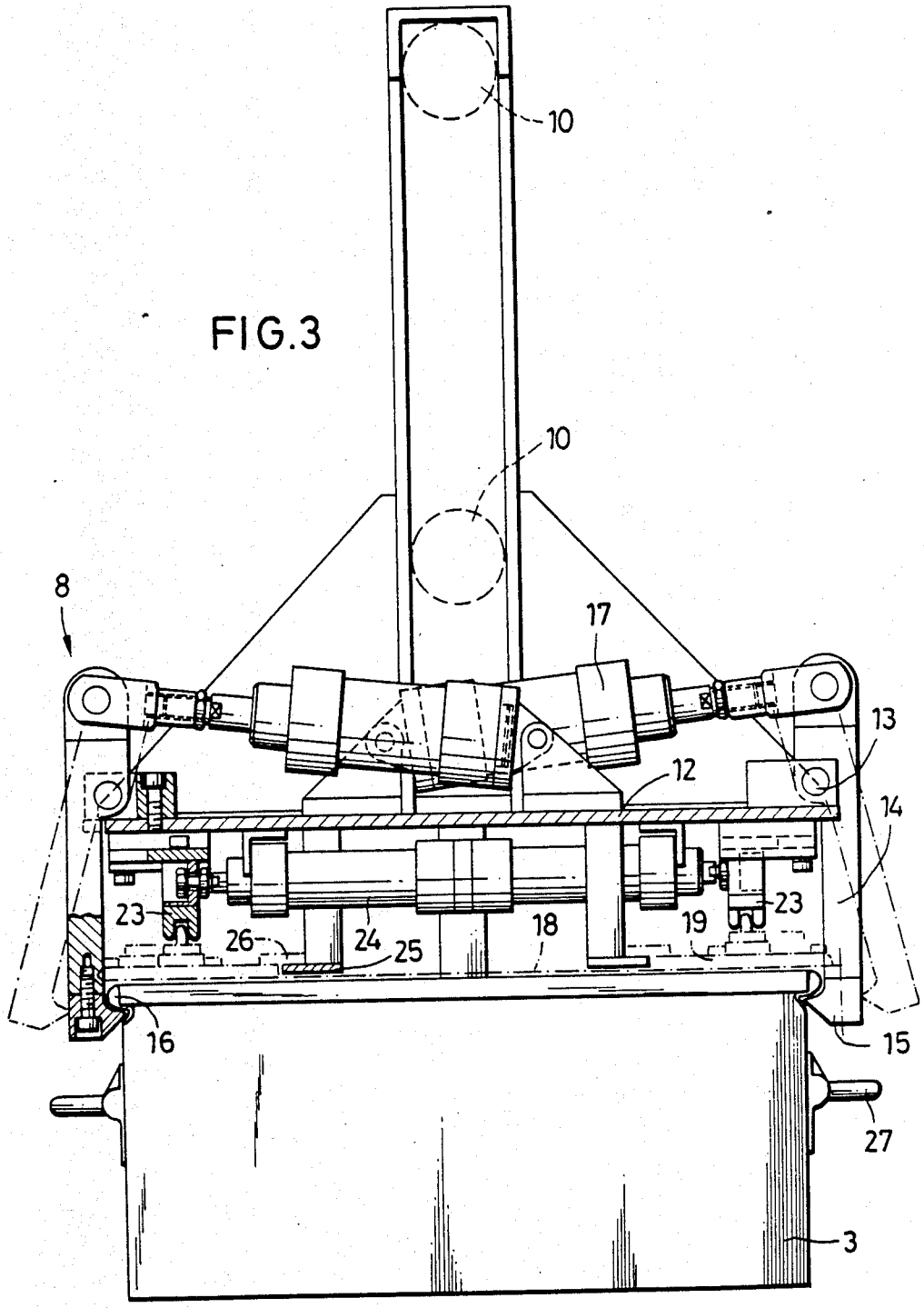
FIG. 3 is a side view of the gripping device with a box.

A lifting and lowering device 9 is arranged in the carriage 7 and has a lifting frame 11 which is fixedly connected with the carriage 7. A gripping frame 12 is liftably and lowerably guided in the lifting frame 11 via rollers 10. Turnable gripping levers 14 are supported on the small sides of the gripper frame 12 turnably about pivot axles 13. The turnable ends of the gripping levers 14 are provided with claws 15. As can be seen from FIG. 3 gripper levers 14 can be spread by means of the gripper cylinder-piston unit 17 so that they grip with their gripper claws 15 over beaded edges 16 arranged on the small sides of the box 3. The gripper levers 14 are turnable so that the gripper claws 15 engage under the bead edge 16 of the box 3 and thereby the box can be reliably lifted and transported.

Figure 6:
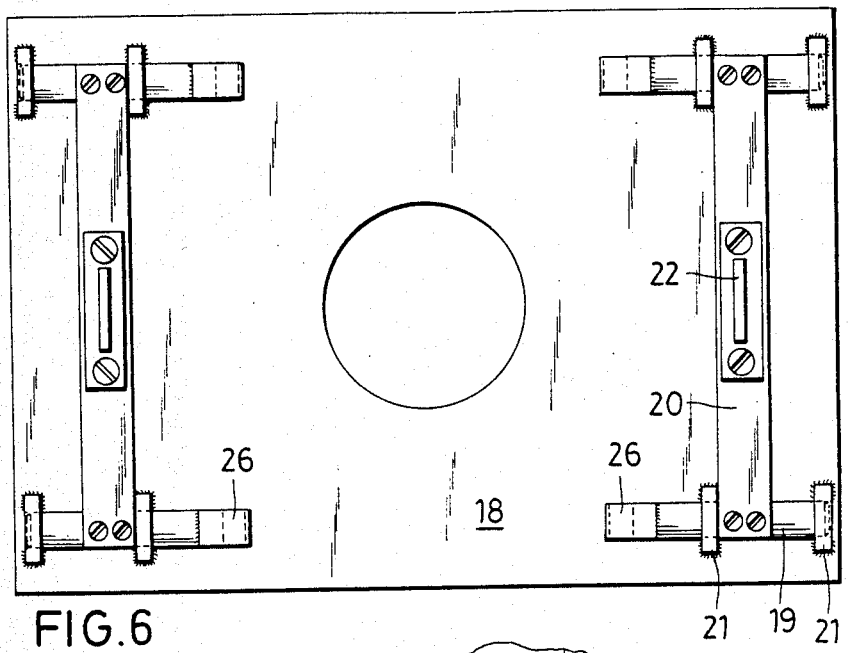
FIG. 6 is a plan view of a box cover with locking device.
Figure 7:
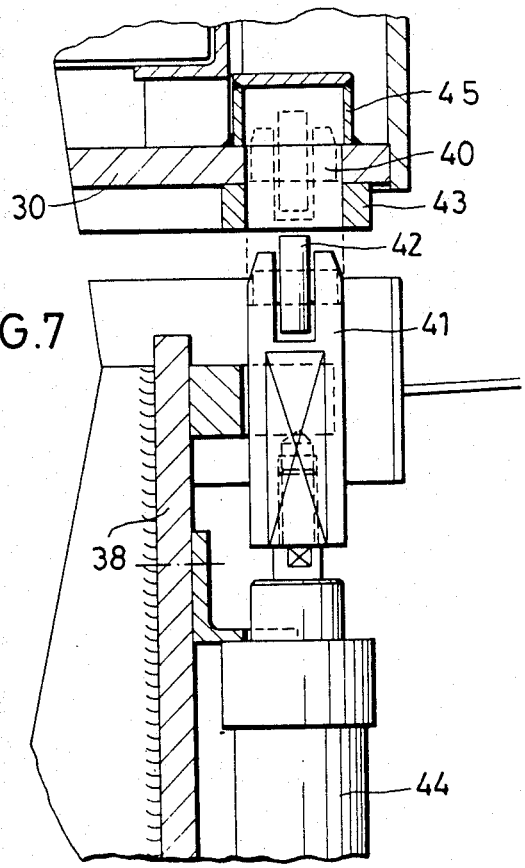
FIG. 7 is a view showing a fragment of a fixing device.

The boxes 3 which are filled with industrial piece goods and transported by the supply device 4 are closed with a cover 18 prior to their insertion into the centrifuge 1 or 1' as particularly shown in FIG. 6. The cover 18 is provided on its upper side with four latches 19 which lock the cover 18 with the box 3. Two latches 19 provided on each small side are connected with one another by a latch bridge 19. The latches 19 are guided in latch guides 21 displaceable in a longitudinal direction.

A web 22 is located under the latch bridge and is engageable by a displaceable driver 23. Two displaceable drivers 23 are provided under the gripper frame and can be moved by an opening and closing cylinder-piston unit 24 in longitudinal direction of the latch 19. When a box 3 is engaged by the gripping device 8, the cover 18 which is held in the gripping device 8 is applied onto the box 3 and with the box 3 by opposite movement of the drivers 23.

A fixed cover holder 25 is located on the lower side of the gripper frame 12 and set with flat rails on the upper side of the cover 18. Bends 26 are provided at the inner end of the four latches 19 and moved over the flat rails of the cover holder 26 when the drivers 23 displace the latches 19 to the opening position. The cover 18 is held in the gripping device 8 as long as the latching device 19–22 is brought in the opening position. When, however, the latching device 19–22 is in the working position, the cover holder 23 is free.

As can be seen from FIG. 4, a centrifuge drum 2 is mounted with drum bottom 30 on a substantially vertical motor shaft 33. A drive motor 34 is mounted on a motor support 35 which is held via a pin 36 in an elastic bearing 37. Since the centrifuge drum 2 swings with its drive motor 34 in the elastic bearing 37, the guide of a catch pin 41 is mounted on a console 38 which is fixedly connected with the motor support 35. The catch pin 41 is provided with a conically extending tip. A roller 42 is mounted in this tip. After adjusting of the catch pin by means of an adjusting cylinder-piston unit 44, the roller 42 rolls on the drum bottom 30 or on an associated running ring 43. When the drum 2 after its braking and adjusting of the catch pin reaches the proper position, the catch pin 41 moves into one or both recesses 40 and thereby holds the centrifuge drum 2 in the proper position, so that the box 3 can be engaged without difficulties by the gripping device 8.

The box 3 supplied by the supply device abuts against an abutment 39. The abutment serves for placing the supplied box so that it can be unobjectionably engaged by the gripping device 8 and supplied to one or both centrifuges 1 and 1'. The fixing device 40–45 serves the purpose that after centrifuging the centrifuge drum 2 or 2' which is a proper gripping position. Each supplied box 3 which is taken by the gripping device is closed with the cover 18 and locked. After discharge of a centrifuged box 3, the gripping device 8 takes over the cover and holds it until a new box supplied by the supply device 4 must be provided with a cover and locked.

The recess 40 in the drum bottom 30 are closed from the drum interior by leads 44. The centrifuged liquid is collected by a bath 28 and discharged through a discharge 29.

It will be understood that each of the elements described above, or two or more together, may also find a useful application in other types of constructions differing from the types described above.

While the invention has been illustrated and described as embodied in a centrifuging installation, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A centrifuging installation, comprising at least one centrifuge which is loaded and emptied automatically and has an axis, said centrifuge having a centrifuge drum which is provided with the receiving frame, the receiving frame being rectangular in a plan view and having four corners spaced at equal distances from said centrifuge axis;

a plurality of containers which can be filled with industrial piece goods and are insertable into said centrifuge, said container having walls with passages for centrifuged liquid and an upper edge, said containers being formed as boxes in a plan view and insertable into the receiving frame; fixing means provided in said centrifuge and arranged to hold said centrifuge drum after braking in a predetermined position; a cover arranged to close said boxes and provided with locking means; and gripping means for said boxes, said gripping means being provided with actuating means for opening and closing said locking means of said cover, said gripping means being also provided with a cover holder which fixes said cover after opening of said locking means and releases the same after closing of said locking means.

2. An installation as defined in claim 1, wherein said drum has a drum bottom with an edge region, said fixing means including two recesses arranged diametrically in said edge region of said drum bottom, and a catching pin engageable in each of said recesses.

3. An installation as defined in claim 2, wherein said centrifuge has a drive motor with a substantially vertical motor shaft which supports said centrifuge drum, an elastically supported motor support which carries said drive motor, and a console fixedly connected with said motor support, said catching pin being supported and guided longitudinally moveably in said console.

4. An installation as defined in claim 3, wherein said catching pin has a tip; and further comprising a roller which is supported in said tip of said catching pin, said roller being arranged to run on said drum bottom and engages in said recess of said drum bottom.

5. An installation as defined in claim 4; and further comprising a running ring located under said drum bottom and provided with said recesses for said roller.

6. An installation as defined in claim 1, wherein said locking means include two pairs of longitudinally displaceable latches and a latch bridge connecting the latches of each pair with one another, each of said latch bridges having a center and a web mounted in said center; said gripping means having a gripping frame with a lower side, said actuating means having drivers which cooperate with said web and are displaceable on said lower side of said gripping frame in opposite directions.

7. An installation as defined in claim 6, wherein said actuating means have a working cylinder-piston unit which drivingly supports said drivers.

8. An installation as defined in claim 6, wherein said gripping means have a lower side; and further comprising a second such cover holder, said cover holders being arranged on said lower side of said gripping means and having flat rails arranged to lie on said cover so that said latches move over said rails during opening.

* * * * *